US006901764B2

(12) United States Patent
An et al.

(10) Patent No.: US 6,901,764 B2
(45) Date of Patent: Jun. 7, 2005

(54) ICE-MAKING APPARATUS IN REFRIGERATOR

(75) Inventors: Si Yeon An, Changwon-shi (KR); Da Un Jang, Changwon-shi (KR)

(73) Assignee: LG Electroincs Inc., Seoul (KR)

( * ) Notice: Subject to any disclaimer, the term of this patent is extended or adjusted under 35 U.S.C. 154(b) by 0 days.

(21) Appl. No.: 10/419,148

(22) Filed: Apr. 21, 2003

(65) Prior Publication Data

US 2003/0192327 A1 Oct. 16, 2003

Related U.S. Application Data

(62) Division of application No. 10/216,185, filed on Aug. 12, 2002, now Pat. No. 6,571,567.

(30) Foreign Application Priority Data

Sep. 7, 2001 (KR) ..... 2001-55222
Sep. 7, 2001 (KR) ..... 2001-55223

(51) Int. Cl.[7] ..... F25C 1/00
(52) U.S. Cl. ..... 62/135; 62/137; 62/347; 62/353
(58) Field of Search ..... 62/135, 137, 72, 62/340, 347, 353

(56) References Cited

U.S. PATENT DOCUMENTS 4,306,423 A 12/1981 Webb et al.
5,182,916 A * 2/1993 Oike et al. ..... 62/135
5,212,955 A * 5/1993 Hogan ..... 62/73
5,400,605 A 3/1995 Jeong
5,809,797 A * 9/1998 Ryu ..... 62/340
5,829,266 A * 11/1998 Lyu ..... 62/353
5,946,924 A 9/1999 Kim
5,970,725 A * 10/1999 Lee ..... 62/137
6,044,658 A * 4/2000 Ryu ..... 62/353
6,161,390 A 12/2000 Kim
6,276,160 B1 * 8/2001 Terada et al. ..... 62/353
2002/0014087 A1 * 2/2002 Kwon

FOREIGN PATENT DOCUMENTS

JP 406001736 a * 8/1994
JP 11083260 A * 3/1999
JP 2000088411 A * 3/2000
JP 02000258007 A * 9/2000

* cited by examiner

*Primary Examiner*—William E. Tapolcai
*Assistant Examiner*—Mohammad M. Ali
(74) *Attorney, Agent, or Firm*—McKenna Long & Aldridge LLP

(57) ABSTRACT

A refrigerator ice-making apparatus that prevents or reduces interference between a water supply pipe and an ice-making vessel. The rotational axis of a motor driven ice-making vessel is controlled such that contact between the water supply pipe and the ice-making vessel, which is below the water supply pipe, is prevented or reduced. The rotational axis is either offset from the center of the ice-making vessel or varies by contact between the water supply pipe and the ice-making vessel.

18 Claims, 7 Drawing Sheets

ICE-MAKING APPARATUS IN REFRIGERATOR

This application is a divisional of U.S. patent application Ser. No. 10/216,185 filed Aug. 12, 2002 Now U.S. Pat. No. 6,571,567.

This application claims the benefit of the Korean Application Nos. P2001-55222 and P2001-55223, which were filed on Sep. 7, 2001, and which are hereby incorporated by reference.

BACKGROUND OF THE INVENTION

1. Field of the Invention

The present invention relates to refrigerators. More particularly, the present invention relates to ice-making equipment used in refrigerators.

2. Discussion of the Related Art

Refrigerators typically include cold-storage rooms and freezers that are maintained at constant, low temperatures. To accomplish this, a refrigerator incorporates a refrigerating system that includes a compressor, a condenser, a capillary tube, and an evaporator. Liquid refrigerant at low temperature and pressure passes through refrigerant tubes in the evaporator so as to absorb heat from air near the evaporator. Thus, the air temperature around the evaporator is cooled. That cooled air is supplied to the cold-storage room and freezer, thus cooling the interior of the refrigerator.

Modern refrigerators often include an ice-making plant in the freezer. A typical ice-making plant is briefly explained with reference to FIG. 1. As shown, a water supply pipe 2 is installed in a refrigerator body 1. That supply pipe, which receives water from an external source, is connected to a valve 3 inside the refrigerator. The valve 3 controls water flow both to a dispenser 7 and to an ice-making plant 10. Water flows to the dispenser 7 by way of connecting pipes 4*a* and 4*b* and by way of a water tank 5 that stores a predetermined amount of water. Water flows to the ice-making plant 10 by way of an external supply pipe 8 that runs along the rear of the refrigerator and that connects to an internal supply pipe 9 that extends into the freezer above the ice-making plant 10.

Referring now to FIG. 2A, a typical prior art ice-making plant 10 includes an ice-making vessel 12, a motor assembly 14 for revolving the ice-making vessel 12, and an ice storage vessel (not shown) for storing ice. The motor assembly 14 includes a driving shaft 15 that connects to the center of the ice-making vessel 12. Thus, as shown, the rotational axis X of the ice-making vessel 12 passes through the center of the ice-making vessel 12. An ice-checking lever 18 is installed along a side of the motor assembly 14. That ice-checking lever 18 measures the amount of ice stored in the ice storage vessel.

The operation of the ice-making plant 10 is as follows. Referring now to FIG. 2B, after the ice-making vessel 12 is supplied with water by the internal supply pipe 9, the cold air in the freezer turns the water in the ice-making vessel 12 to ice. Periodically, the ice-checking lever 18 measures the quantity of stored ice in the ice storage vessel. If the quantity of stored ice is less than a predetermined level, the motor assembly 14 rotates the ice-making vessel 12. After the ice-making vessel 12 rotates by a predetermined angle, it contacts a stopper 19. Further rotation twists the ice-making vessel 12 against the stopper 19 causing ice in the ice-making vessel 12 to separate from the ice-making vessel 12 and to fall into the ice storage vessel. Thereafter, the ice-making vessel 12 is returned to its initial position and is refilled with water from the internal supply pipe 9.

Still referring to FIG. 2B, the ice-making vessel 12 is preferably installed very close to the end of the internal supply pipe 9. If that end is too far from the ice-making vessel 12, the supplied water can splash out of the ice-making vessel 12. Therefore, close spacing between the internal supply pipe 9 and the ice-making vessel 12 is desirable. However, if the internal supply pipe 9 is too close, rotation of the ice-making vessel 12 causes contact between the internal supply pipe 9 and the ice-making vessel 12. Such contact can create various problems.

First, contact between the internal supply pipe 9 and the ice-making vessel 12 can damage the internal supply pipe 9 and/or the ice-making vessel 12. Such damage can prevent ice from forming and can also result in broken pieces of the internal supply pipe 9 and/or the ice-making vessel 12 being mixed with the ice.

Second, contact between the internal supply pipe 9 and the ice-making vessel 12 can induce a positional deviation of the end of the internal supply pipe 9 that causes water to splash from the ice-making vessel 12.

Third, even if there is no immediate damage, contact between the internal supply pipe 9 and the ice-making vessel 12 can hinder the rotation of the ice-making vessel 12 such that an excessive electrical load can be placed on the motor assembly 14. Over time, such an excessive electrical load can damage the motor assembly 14.

Therefore, an improved ice-making apparatus that prevents contact between an internal supply pipe and an ice-making vessel would be beneficial. Even more beneficial would be an improved ice-making apparatus that prevents contact between an internal supply pipe and an ice-making vessel that is located close to the internal supply pipe.

SUMMARY OF THE INVENTION

Accordingly, the present invention is directed to an ice-making apparatus that substantially obviates one or more problems due to limitations and disadvantages of the related art.

An advantage of the present invention is to provide an ice-making apparatus in a refrigerator that prevents interference between a water supply pipe and an ice-making vessel.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these and other advantages and in accordance with the purpose of the invention, as embodied and broadly described herein, an ice-making apparatus in a refrigerator according to the present invention includes a supply pipe for guiding water for ice making, a motor assembly for generating a rotational force, and an ice-making vessel under the supply pipe that is coupled to the motor assembly such that the ice-making vessel has an off-center rotational axis.

The off-center rotational axis causes the ice-making vessel to rotate in a manner that avoids contact between the ice-making vessel and the water supply pipe.

In another aspect of the present invention, an ice-making apparatus for a refrigerator includes a water supply pipe, a motor assembly for generating a turning force, and an ice-making vessel under the water supply pipe that is coupled to the motor assembly. An icemaker cover surrounds and supports the ice-making vessel such that the rotational axis of the ice-making vessel moves when the ice-making vessel contacts the water supply pipe. Movement of the rotational axis is such that interference between the ice-making vessel and the water supply pipe is reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to illustrated embodiments of the present invention, examples of which are shown in the accompanying drawings. Wherever possible, the same reference numbers will be used throughout the drawings to refer to the same or to like parts.

Figure 3:
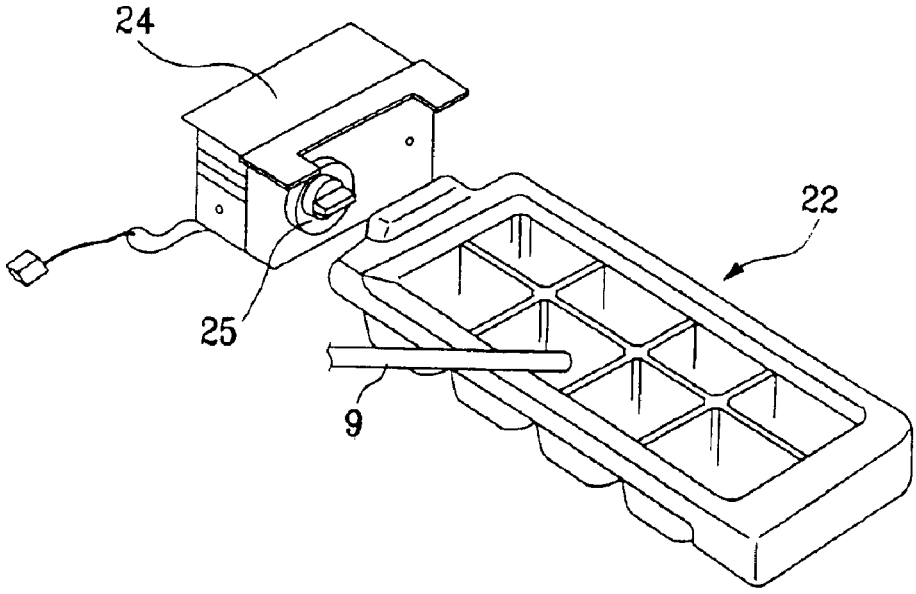
FIG. 3 is a schematic depiction of an ice-making apparatus according to a first embodiment of the present invention.
Figure 4:
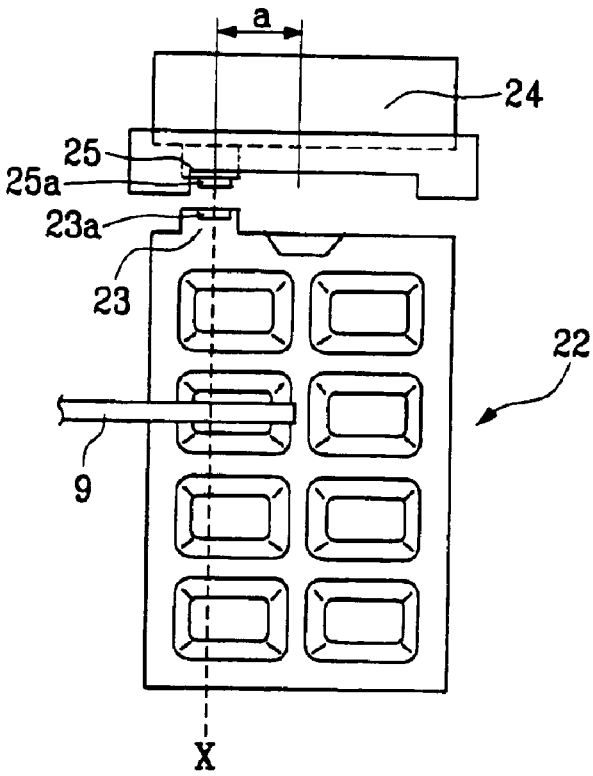
FIG. 4 is a top-down view of the ice-making apparatus shown in FIG. 3.

FIG. 3 schematically illustrates an ice-making apparatus according to a first embodiment of the present invention, while FIG. 4 provides a top-down view of that apparatus. Referring now to FIG. 3 and to FIG. 4, an ice-making apparatus according to a first embodiment of the present invention includes an internal supply pipe 9 that guides water for ice making. A motor assembly 24, having an internal motor, connects to a side of an ice-making vessel 22 that is beneath the internal supply pipe 9. As shown, the internal supply pipe 9 beneficially passes over a side of the ice-making vessel 22.

To prevent interference between the ice-making vessel 22 and the internal supply pipe 9, the rotational axis X (shown in FIG. 4) of the ice-making vessel 22 is off-center by a predetermined interval "a." To accomplish this, the motor assembly 24 includes a driving shaft 25 that mates with a coupling groove 23 on a side (left) of the ice-making vessel 22. Beneficially, the driving shaft 25 ends in a coupling protrusion 25*a* that fits into a coupling groove 23*a* at the end of the coupling part 23. Therefore, the rotational axis X of the ice-making vessel 22 extends along the driving shaft 25 and through the side (left) of the ice-making vessel 22.

Figure 1:
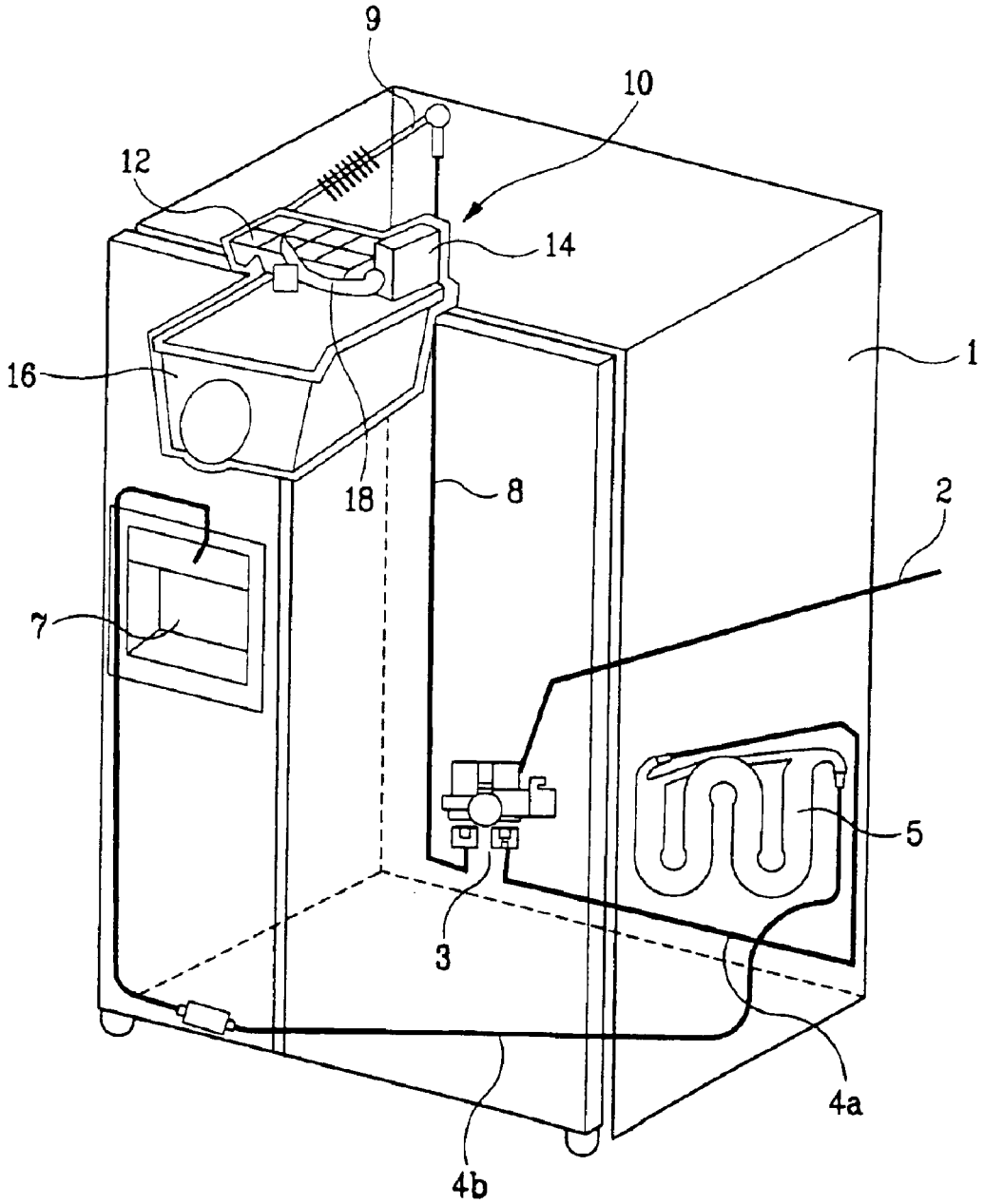
FIG.1 Prior Art
FIG. 1 is a schematic depiction of a typical refrigerator.
Figure 2A:
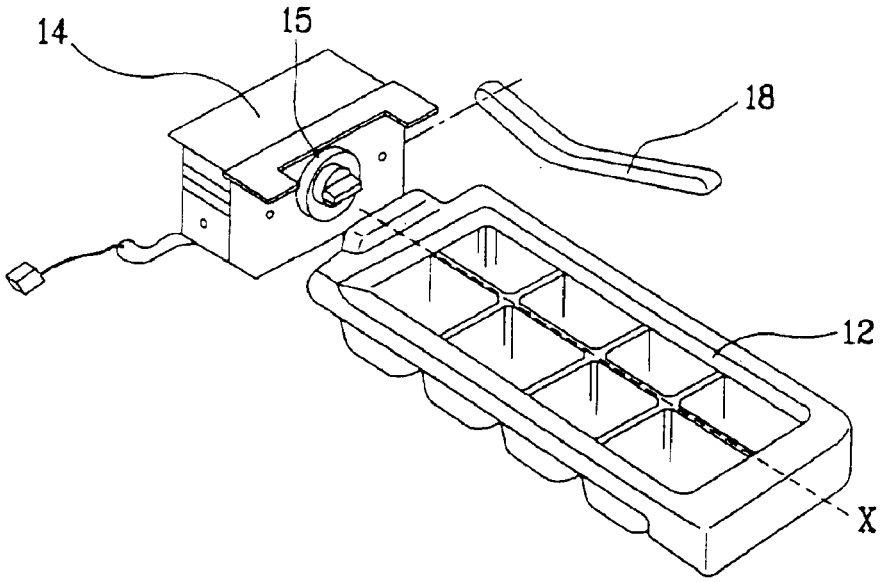
FIG. 2A Prior Art
FIG. 2A is a simplified schematic depiction of a prior art ice-making apparatus suitable for use in the refrigerator shown in FIG. 1.
Figure 2B:
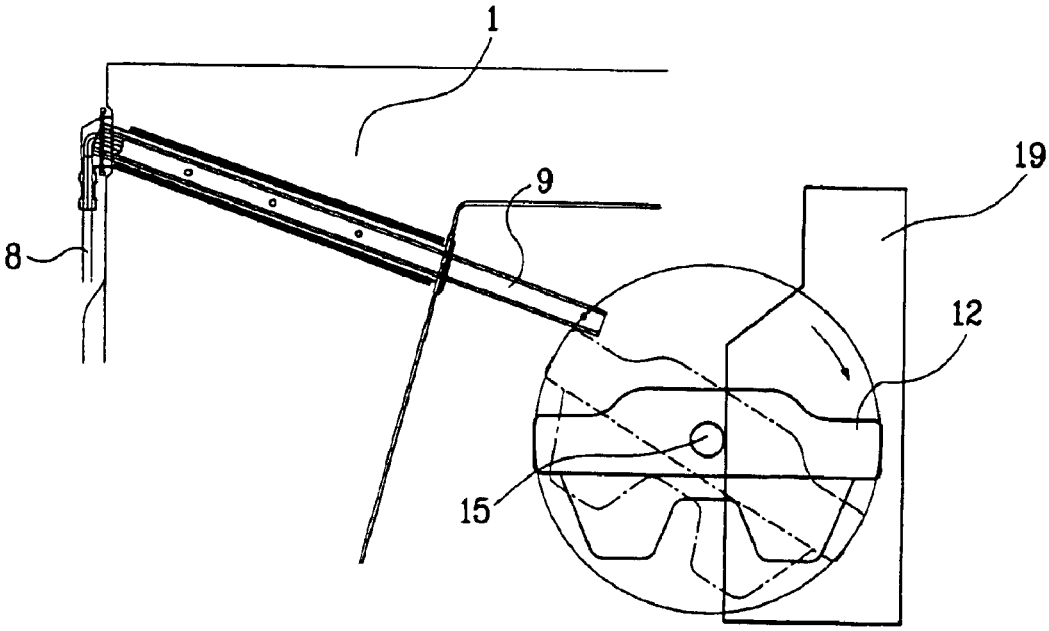
FIG. 2B Prior Art
FIG. 2B illustrates the operation of the ice-making apparatus shown in FIG. 2A.
Figure 5:
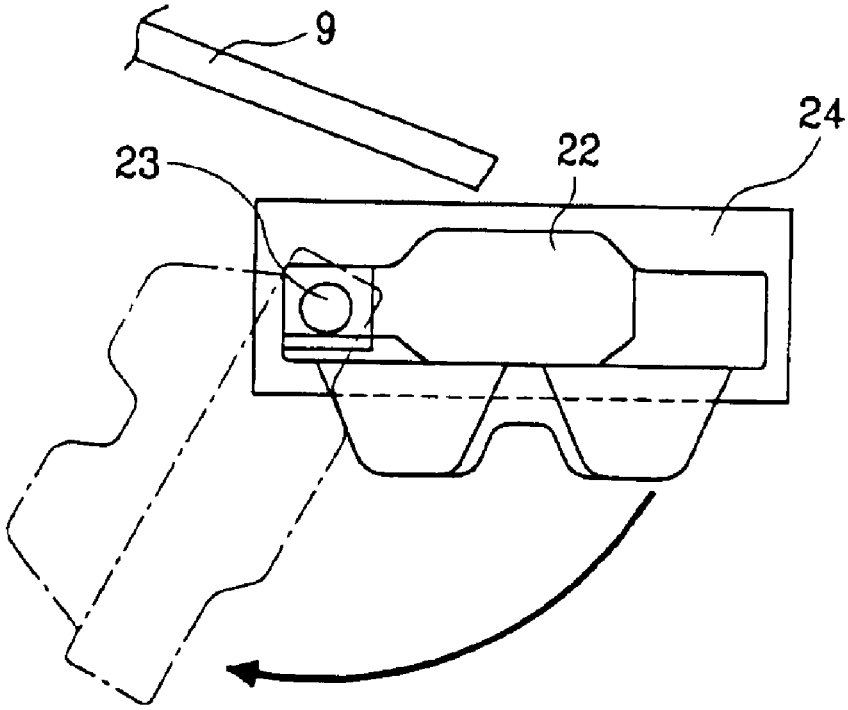
FIG. 5 illustrates the operation of the ice-making apparatus shown in FIGS. 3 and 4.

The operation of the ice-making apparatus is explained with reference to FIG. 5. In FIG. 5, the solid line indicates the ice-making vessel 22 when making ice, while the dotted line represents the ice-making vessel 22 when ice is being separated. It is assumed in FIG. 5 that water in the ice-making vessel 22 is frozen. The ice-checking lever 18 (not shown in the FIG. 5, but reference FIG. 2A) operates to measure the level of the ice stored in an ice storage vessel (not shown). If the level is low, electric power is applied to the motor assembly 24 to rotate the ice-making vessel clockwise along the rotational axis X that passes through the coupling part 23.

Because the internal supply pipe 9 and the rotational axis of the ice-making vessel 22 are on one side (the left) of the ice-making vessel 22, rotation of the ice-making vessel 22 is such that the ice-making vessel 22 does not contact the internal supply pipe 9. Beneficially, the angle of rotation of the ice-making vessel 22 is limited. This prevents contact of the bottom of the ice-making vessel 22 with the internal supply pipe 9 if the ice-making vessel rotates excessively.

After the ice-making vessel 22 has rotated sufficiently, it contacts a stopper (not shown). Additional rotation twists the ice-making vessel 22 against the stopper such that ice separates from the ice-making vessel 22 and drops into the ice storage vessel. Then, the ice-making vessel 22 is rotated counterclockwise to return it to its initial position. The ice-making vessel 22 is then supplied with additional water by the internal supply pipe 9 so as to produce additional ice.

Figure 6:
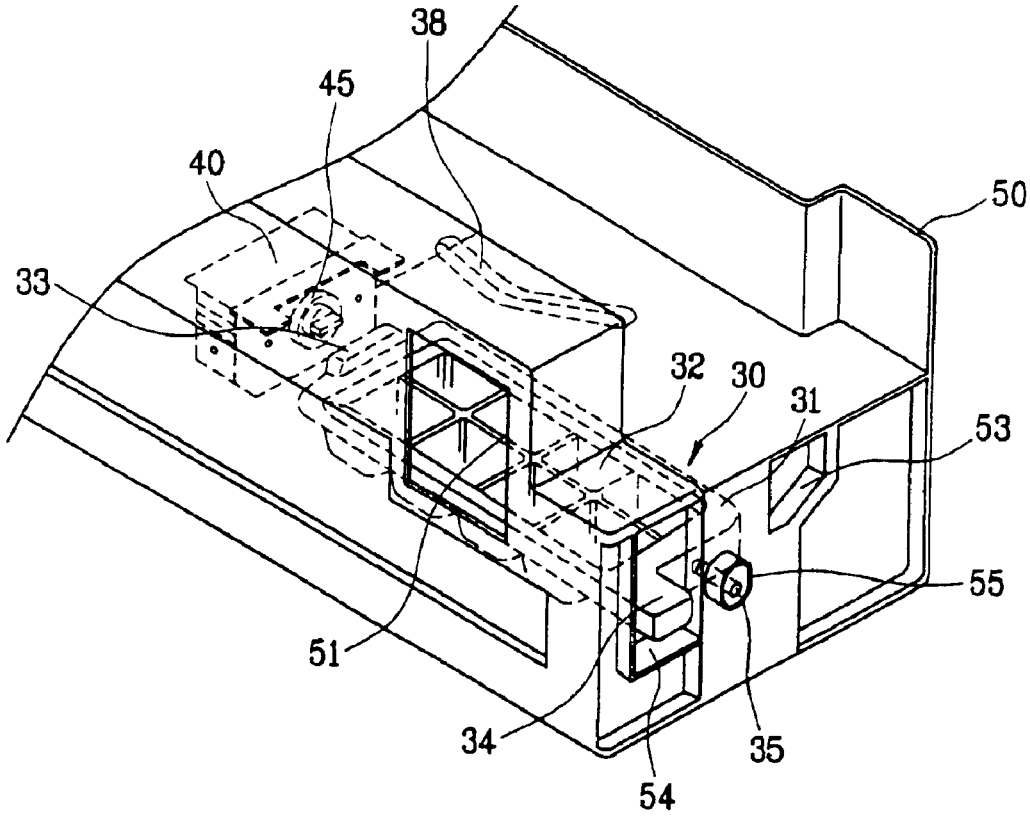
FIG. 6 is a schematic depiction of an ice-making apparatus according to a second embodiment of the present invention.

FIG. 6 illustrates an ice-making apparatus according to a second embodiment of the present invention. It should be understood that the second embodiment also includes an internal supply pipe 9 (see FIGS. 7A and 7B) that receives water from an external supply. A motor assembly 40 having an internal motor connects to an end of an ice-making vessel 30. That ice-making vessel 30 is under the internal supply pipe 9. An icemaker cover 50 (or shield) encompasses the ice-making vessel 30 and the motor assembly.

The ice-making vessel 30 includes an elongated vessel body 31 having ice-making pockets 32. A coupling part 33 at an end of the vessel body 31 mates with a driving shaft 45 of the motor assembly 40. Additionally, the vessel body 31 includes a support protrusion 34 at the end opposite the coupling part 33. Beneficially, the coupling part 33 is located along a central rotational axis of the vessel body 31.

The icemaker cover 50 includes a landing protrusion 54 that extends inward toward the ice-making vessel 30. The landing protrusion 54 interacts with the support protrusion 34 to prevent the ice-making vessel 30 from rotating (counterclockwise) by its own weight when the ice-making pockets 32 are filled.

Still referring to FIG. 6, the ice-making vessel 30 includes an outwardly protruding support rod 35 that is located along the rotational axis of the ice-making vessel 30. Thus, the rotational axis extends from the coupling part 33, through the vessel body 31, and along the support rod 35. The support rod 35 fits into a guide hole 55 at the front of the icemaker cover 50.

The guide hole 55 is significantly larger than the support rod 35 to enable the rotational axis to move over a predetermined interval. This reduces interference between the ice-making vessel 30 and the internal supply pipe 9 when the ice-making vessel 30 rotates. Specifically, rotation of the ice-making vessel 30 can cause the ice-making vessel 30 to contact the internal supply pipe 9. Such contact produces a force that causes the rotational axis of the ice-making vessel 30 to move so as to reduce the interference. Thus, the position of the support rod 35 moves in the guide hole 55.

Beneficially, the guide hole 55 is elliptically shaped, with the longer axis dimensions extending up and down. However, some right and left movement of the support rod 35 in the guide hole 55 is beneficially also provided for. While beneficial, an elliptically shaped guide hole 55 is not required. Also beneficially, when the support protrusion 34 is on the landing protrusion 54 the support rod 35 does not contact the wall that forms the guide hole 55.

The icemaker cover 50 also includes on its front face an inwardly protruding stopper 53. The stopper 53 limits the rotation of the ice-making vessel 30. Thus, the stopper 53 is located in the rotational trajectory of the support protrusion 34 and is formed on the opposite side of the guide hole 55 than the landing protrusion 54. As the ice-making vessel 30 rotates, the support protrusion 34 comes into contact with the stopper 53. Further rotation of the ice-making vessel 30 twists the ice-making vessel 30 so as to separate the ice.

Referring to FIG. 6, the icemaker cover 50 includes a side opening 51 through which the internal supply pipe 9 passes as it enters the icemaker cover 50. Finally, FIG. 6 shows an ice-checking lever 38 for sensing the level of stored ice in an ice storage vessel.

Figure 7A:
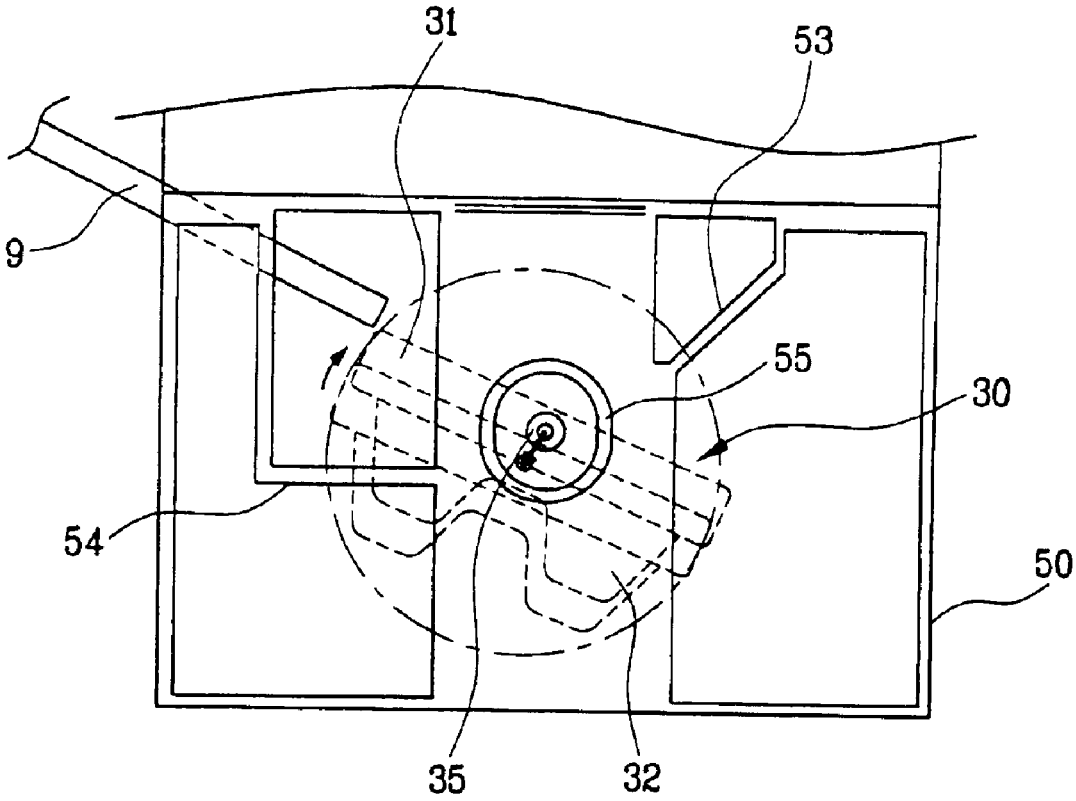
FIG. 7A and FIG. 7B illustrate the operation of the ice-making apparatus shown in FIG. 6.
Figure 7B:
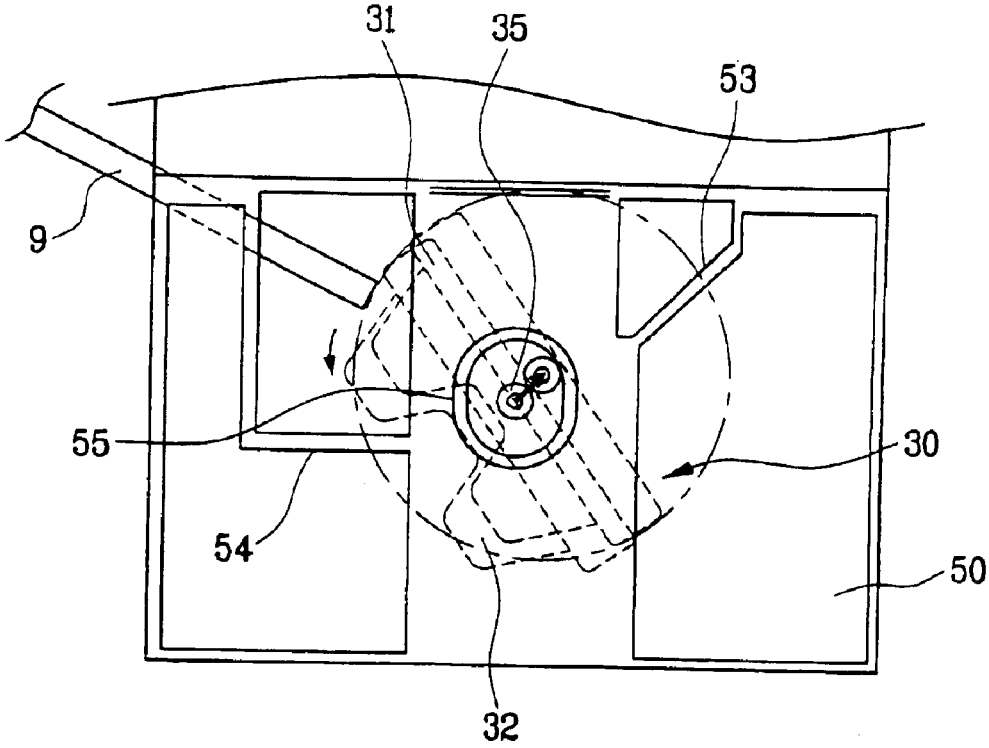

FIG. 7A and FIG. 7B further illustrate the operation of the second embodiment ice-making apparatus. Referring now to FIG. 7A, the internal supply pipe 9 supplies water to the ice-making pockets 32 of the ice-making vessel 30. That water is subsequently frozen into ice. The ice-checking lever 38 (see FIG. 6) measures the level of the stored ice in an ice storage vessel under the ice-making vessel 30. When the stored ice level is below a predetermined level, power is applied to a motor in the motor assembly 40. The motor rotates the ice-making vessel 30 clockwise along an axis determined by the support rod 35. As the ice-making vessel 30 rotates, the side (left) of the ice-making vessel 30 contacts the end of the internal supply pipe 9. Further rotation causes the ice-making vessel 30 to move its rotational axis downward such that the support rod 35 moves lower in the guide hole 55. This reduces interference between the ice-making vessel 30 and the internal supply pipe 9. When contact between the internal supply pipe 9 and the ice-making vessel 30 is lost the support rod 35 returns to its normal position.

The ice-making vessel 30 continues rotating until the support protrusion 34 contacts the stopper 53. Further rotation of the ice-making vessel 30 causes the ice-making vessel 30 to twist, separating the ice from the ice-making vessel 30 such that the ice falls into the ice storage vessel.

Referring now to FIG. 7B, after the ice has fallen, the motor assembly 40 rotates the ice-making vessel 30 in the opposite direction (counterclockwise). After the ice-making vessel 30 has rotated sufficiently, the left side of the ice-making vessel 30 again comes into contact with the end of the internal supply pipe 9. This contact causes the support rod 35, and thus the rotational axis of the ice-making vessel 30, to move upward in the guide hole 55. Therefore, interference between the ice-making vessel 30 and the internal supply pipe 9 is reduced. Subsequently, after further rotation of the ice-making vessel 30, contact is lost between the internal supply pipe 9 and the ice-making vessel 30 and the support rod 35 returns to its normal position.

The ice-making vessel 30 keeps rotating counterclockwise until the support protrusion 34 lands on the landing protrusion 54. Then, the ice-making vessel 30 is once again supplied with water from the internal supply pipe 9 so that additional ice can be formed.

The principles of the present invention enable the reduction in, or prevention of, interference between an ice-making vessel and an internal supply pipe.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A refrigerator having an ice-making apparatus, comprising:

a supply pipe for supplying water for ice making;

a motor assembly for producing a rotational force;

an ice-making vessel coupled to the motor assembly, the ice-making vessel including a protruding support rod; and an icemaker shield having a guide opening around the support rod that enables rotation of the ice-making vessel, the guide opening being configured to allow movement of a rotational axis of the ice-making vessel during operation of the ice-making apparatus when the vessel contacts the supply pipe.

2. The refrigerator according to claim 1, wherein the support rod forms the rotational axis of the ice-making vessel.

3. The refrigerator according to claim 2, wherein the guide opening is elliptically shaped and formed such that the support rod can move up and down within the guide opening.

4. The refrigerator according to claim 1, further comprising:

a support protrusion on the ice-making vessel; and a landing protrusion on the icemaker shield;

wherein the support protrusion lands on the landing protrusion so as to limit rotation of the ice-making vessel in a first direction.

5. The refrigerator according to claim 4, further comprising a stopper that interacts with the support protrusion to limit rotation of the ice-making vessel in a second direction.

6. The refrigerator according to claim 1, wherein the icemaker shield is part of an icemaker cover that at least partially encloses the ice-making vessel.

7. The refrigerator according to claim 6, wherein the icemaker cover includes an opening that receives the supply pipe.

8. The refrigerator according to claim 3, wherein the motor assembly produces both a clockwise rotational force and a counterclockwise rotational force.

9. The refrigerator according to claim 8, wherein the supply pipe is located such that when the motor assembly rotates, the ice-making vessel contacts the supply pipe thereby causing the support rod to move in the guide opening so as to change the rotational axis of the ice-making vessel such that interference between the ice-making vessel and the supply pipe is reduced.

10. The refrigerator according to claim 9, wherein the support rod moves up.

11. The refrigerator according to claim 9, wherein the support rod moves down.

12. The refrigerator according to claim 1, wherein rotation of the motor assembly twists the ice-making vessel.

13. The refrigerator according to claim 12, further including a coupler that couples the ice-making vessel to the motor assembly.

14. The refrigerator according to claim 1, further comprising:

a housing;

a water inlet pipe extending through the housing;

a valve connected to the water inlet pipe that selectively enables water to flow from the water inlet pipe to the supply pipe; and a freezer;

wherein the ice-making vessel is within the freezer.

15. The refrigerator according to claim 14, further including an ice sensor for sensing the level of stored ice.

16. The refrigerator according to claim 15, wherein the ice sensor includes a level arm.

17. The refrigerator according to claim 16, wherein the ice sensor senses when stored ice is below a predetermined level.

18. The refrigerator according to claim 1, wherein the supply pipe is above the ice-making vessel.

* * * * *